US008038152B2

(12) United States Patent
Shimizu et al.

(10) Patent No.: US 8,038,152 B2
(45) Date of Patent: Oct. 18, 2011

(54) SHEET CONVEYANCE RELAY UNIT AND IMAGE FORMING SYSTEM USING THE SAME UNIT

(75) Inventors: Saburo Shimizu, Hachioji (JP); Toshio Shida, Higashiyamato (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 167 days.

(21) Appl. No.: 12/483,410

(22) Filed: Jun. 12, 2009

(65) Prior Publication Data

US 2009/0315248 A1 Dec. 24, 2009

(30) Foreign Application Priority Data

Jun. 18, 2008 (JP) ..... 2008-158900

(51) Int. Cl.
*B65H 39/10* (2006.01)

(52) U.S. Cl. ..... 271/298; 271/225; 271/279

(58) Field of Classification Search ..... 271/9.01, 271/9.13, 225, 279; 270/58.01; 399/407
See application file for complete search history.

(56) References Cited

U.S. PATENT DOCUMENTS

| | | | | |
|---|---|---|---|---|
| 4,721,294 | A | 1/1988 | Petersen | |
| 6,227,540 | B1 | 5/2001 | Nakamura et al. | |
| 6,973,286 | B2 * | 12/2005 | Mandel et al. | 399/391 |
| 7,076,200 | B2 | 7/2006 | Poletto | |
| 7,080,830 | B2 * | 7/2006 | Suzuki et al. | 270/58.08 |
| 7,261,288 | B2 * | 8/2007 | Hosoya et al. | 270/58.07 |
| 7,677,549 | B2 * | 3/2010 | Kosugi | 271/9.13 |
| 2007/0001361 | A1 | 1/2007 | Nakamura et al. | |
| 2008/0112743 | A1 | 5/2008 | Moore | |
| 2009/0057974 | A1 * | 3/2009 | Fairweather et al. | 270/1.01 |

FOREIGN PATENT DOCUMENTS

| | | | |
|---|---|---|---|
| JP | 59-167447 | A | 9/1984 |
| JP | 61-111277 | A | 5/1986 |
| JP | 8-276683 | A | 10/1996 |
| JP | 11-322157 | A | 11/1999 |
| JP | 2002-193541 | A | 7/2002 |
| JP | 2006-124180 | A | 5/2006 |
| JP | 2006-347634 | A | 12/2006 |
| JP | 2008-120598 | A | 5/2008 |

OTHER PUBLICATIONS

Japanese Office Action dated Apr. 20, 2010 and English translation thereof in counterpart Japanese Application No. 2008-158900.

* cited by examiner

*Primary Examiner* — Jeremy R Severson
(74) *Attorney, Agent, or Firm* — Holtz, Holtz, Goodman & Chick, P.C.

(57) ABSTRACT

A sheet conveyance relay unit, including: a convergence unit, including: a convergence section to converge sheet conveyance paths of plural sheet receiving sections; and a first common sheet-conveyance section, which conveys the recording sheets from the convergence section to a sheet feeding outlet; a divergence unit, including: a second common sheet-conveyance section, which conveys the recording sheets conveyed from the convergence unit; plural sheet feed-out sections, which are combined to plural post-finishing apparatuses; and a divergence section, which sorts the recording sheets conveyed by the second common sheet-conveyance section, onto the plural sheet feed-out sections; and a control section which receives job information having been set, and selects an image forming apparatus to be used for a job among the image forming apparatuses and a post-finishing apparatus to be used for the job among the plural post-finishing apparatuses, whereby the control section conducts the job having been set.

10 Claims, 9 Drawing Sheets

SHEET CONVEYANCE RELAY UNIT AND IMAGE FORMING SYSTEM USING THE SAME UNIT

CROSS REFERENCE TO RELATED APPLICATION

This application is based on Japanese Patent Application No. 2008-158900 filed on Jun. 18, 2008, with the Japanese Patent Office, the entire content of which is hereby incorporated by reference.

TECHNICAL FIELD

The present invention relates to a sheet conveyance relay unit, which conveys recording sheets, sent from an image forming apparatus, to a post-finishing apparatus, and relates to an image forming system, which is structured of the image forming apparatus, the post-finishing apparatus, and the sheet conveyance relay unit, moreover relates to a control of the image forming system.

BACKGROUND OF THE INVENTION

In recent years, image forming systems have been widely used, in which a post-finishing apparatus is combined to an image forming apparatus, whereby various post-finishing processes, such as a de-curling process, a sheet reversing process, a hole punching process, a sheet folding process, and a sheet binding process, are conducted on recording sheets carrying images printed by the image forming apparatus.

Generally in such systems, a single post-finishing apparatus is combined to a single image forming apparatus, however, there are many image forming systems, in which a single post-finishing apparatus is combined to a plurality of image forming apparatuses, or a plurality of post-finishing apparatuses are combined to a single image forming apparatus.

Unexamined Japanese Patent Application Publication No. 8-276683 discloses an image forming system in which a single post-finishing apparatus is combined to a plurality of image forming apparatuses.

Further, Unexamined Japanese Patent Application Publication No. 2006-347634 discloses an image forming system in which a plurality of post-finishing apparatuses are combined to a single image forming apparatus.

Still further, Unexamined Japanese Patent Application Publication No. 2006-124180 discloses an image forming system in which a plurality of post-finishing apparatus are combined to a plurality of image forming apparatuses.

Due to advancement toward full color image formation from monochromatic image formation, speeding up of image formation, changing toward multifunction, and separation of functions, each generated in the field of the image forming apparatuses, as well as, due to speeding up of post finishing, diversification of the function and separation of the function, each generated in the field of the post-finishing apparatuses, many parties have tried to meet users' diversifying needs, by increasing the number of the combinations between the image forming apparatuses and the post-finishing apparatuses, or by flexibly changing these combinations.

However, in actual working fields, conventional systems barely meet the increased types of operational jobs, nor improvement of printing productivity, which are problematic matters.

SUMMARY OF THE INVENTION

An aspect of the invention is as follows.

Item 1 A sheet conveyance relay unit, including:

a convergence unit, including:

a convergence section having a plurality of sheet receiving sections respectively connected to a plurality of image forming apparatuses to receive recording sheets, wherein sheet conveyance paths of the plurality of the sheet receiving sections are converged; and a first common sheet-conveyance section, which is configured to convey the recording sheets from the convergence section to a sheet feeding outlet;

a divergence unit, including:

a second common sheet-conveyance section, which is configured to convey the recording sheets conveyed from the convergence unit;

a plurality of sheet feed-out sections, which are combined to a plurality of post-finishing apparatuses; and a divergence section, which sorts the recording sheets conveyed by the second common sheet-conveyance section, onto the plurality of the sheet feed-out sections; and a control section which is configured to receive job information having been set, and to select an image forming apparatus to be used for a job among the plurality of the image forming apparatuses and a post-finishing apparatus to be used for the job among a plurality of the post-finishing apparatuses, so that the control section conducts the job, having been set.

Item 2. An image forming system, including:

a plurality of image forming apparatuses, each forms an image on a sheet;

a plurality of post-finishing apparatuses, each conducts a post-finishing process on the sheet; and the sheet conveyance relay unit of claim 1, which receives the sheets, having been sent from the plurality of the image forming apparatuses, and conveys the sheets sequentially to the plurality of the post-finishing apparatuses, wherein the plurality of the image forming apparatuses and the plurality of the post-finishing apparatuses are combined to the sheet conveyance relay unit.

BRIEF DESCRIPTION OF THE DRAWINGS

The embodiments will now be described, by way of example only, with reference to the accompanying drawings which are meant to be exemplary, not limiting, and wherein like elements are numbered alike in the several figures, in which.

DETAILED DESCRIPTIONS OF THE PREFERRED EMBODIMENTS

Figure 1:
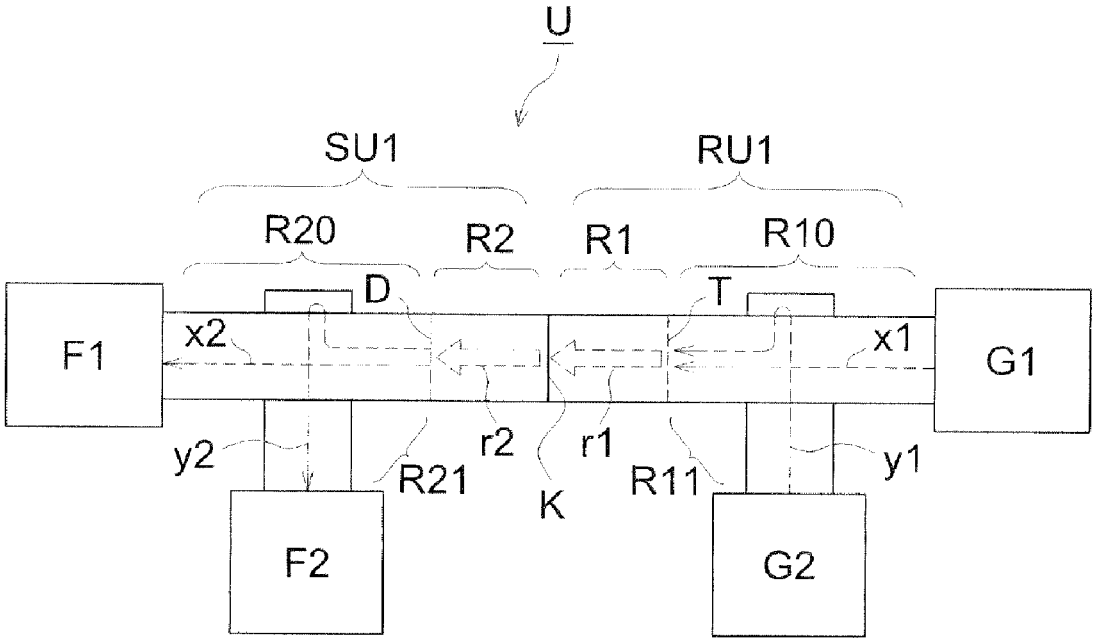
FIG. 1 is a block diagram of an image forming system of the present invention.

Embodiments of the present invention will now be detailed, while referring to the drawings. The present invention is not limited to these embodiments.

FIG. 1 is a block diagram of the image forming system of the present invention.

The image forming system shown in FIG. 1 shows image forming apparatuses G1 and G2, which are connected via sheet conveyance relay unit U, to sheet post-finishing apparatuses F1 and F2.

Sheet conveyance relay unit U is structured of two units, which are convergence unit RU1 and divergence unit SU1, and which are connected through connecting section K.

After a recording sheet is conveyed from image forming apparatus G1, the recording sheet is conveyed through conveyance path x1 of sheet receiving section R10 of convergence unit RU1, the recording sheet is subsequently conveyed to first common sheet-conveyance section R1, through convergence section T.

After another recording sheet is conveyed from image forming apparatus G2, said recording sheet is conveyed through conveyance path y1 of sheet receiving section R11, provided under said conveyance path x1, the recording sheet is subsequently reversed two times, and its conveyance direction is turned 90 degrees, so that the recording sheet is conveyed to first common sheet-conveyance section R1, through convergence section T.

The recording sheet, having been conveyed through conveyance path r1 of first common sheet-conveyance section R1, passes through connecting section K, which is a sheet feeding outlet of convergence unit RU1, and the recording sheet is subsequently conveyed to divergence section D through conveyance path r2 of second common sheet-conveyance section R2 of divergence unit SU1.

The recording sheet, having arrived at divergence section D, is selected to direct to conveyance path x2 of sheet feed-out section R20, or conveyance path y2 of sheet feed-out section R21.

Sheet feed-out sections R20 and R21 convey the recording sheet, having been directed by divergence section D, at predetermined timing and conveyance speed, to post-finishing sections F1 and F2, respectively.

Figure 2:
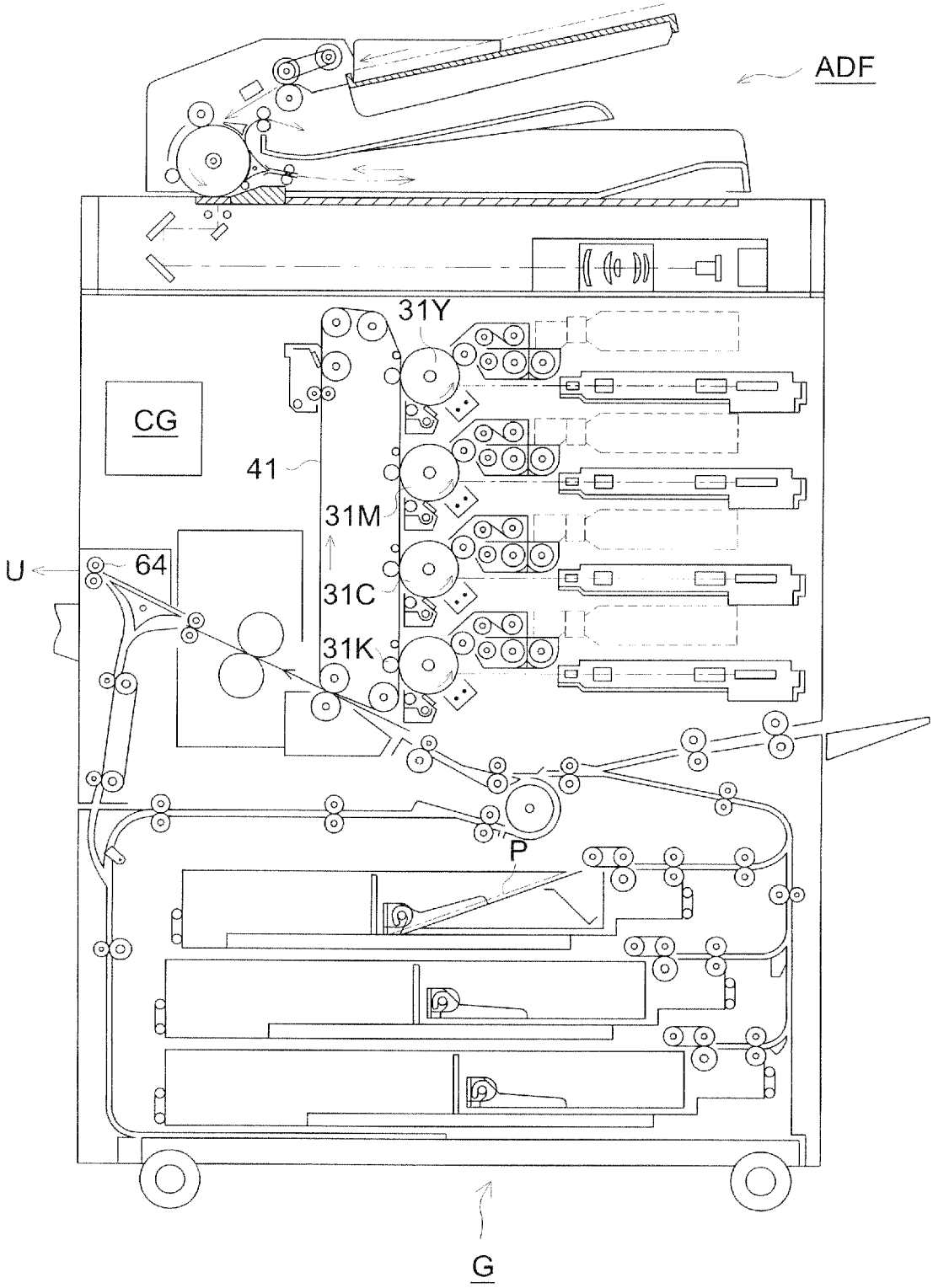
FIG. 2 is a schematic drawing of a full color image forming apparatus.

FIG. 2 is a schematic drawing of full color image forming apparatus G.

Full color image forming apparatus G is a well-known tandem type full color image forming apparatus, as disclosed in Unexamined Japanese Patent Application Publication No. 2007-241175, which includes photoconductors 31Y, 31M, 31C and 31K, aligned vertically to face a single intermediate transfer belt 41, to generate full color images.

Image forming processes are conducted on the recording sheets, based on information which has been acquired by automatic document feeding device ADF, provided on full color image forming apparatus G, or based on information which has been sent from other information devices. After that, the recording sheet, carrying the processed images, is conveyed by paired feed-out rollers 64 to sheet conveyance relay unit U, which is installed downstream of full color image forming apparatus G.

Said sheet conveyance relay unit U can be combined to a monochromatic high-speed image forming apparatus, as well as to full color image forming apparatus G. Further, said sheet conveyance relay unit U can be combined to the image forming apparatuses in different types, or to a plurality of image forming apparatuses in the same type.

Figure 3:
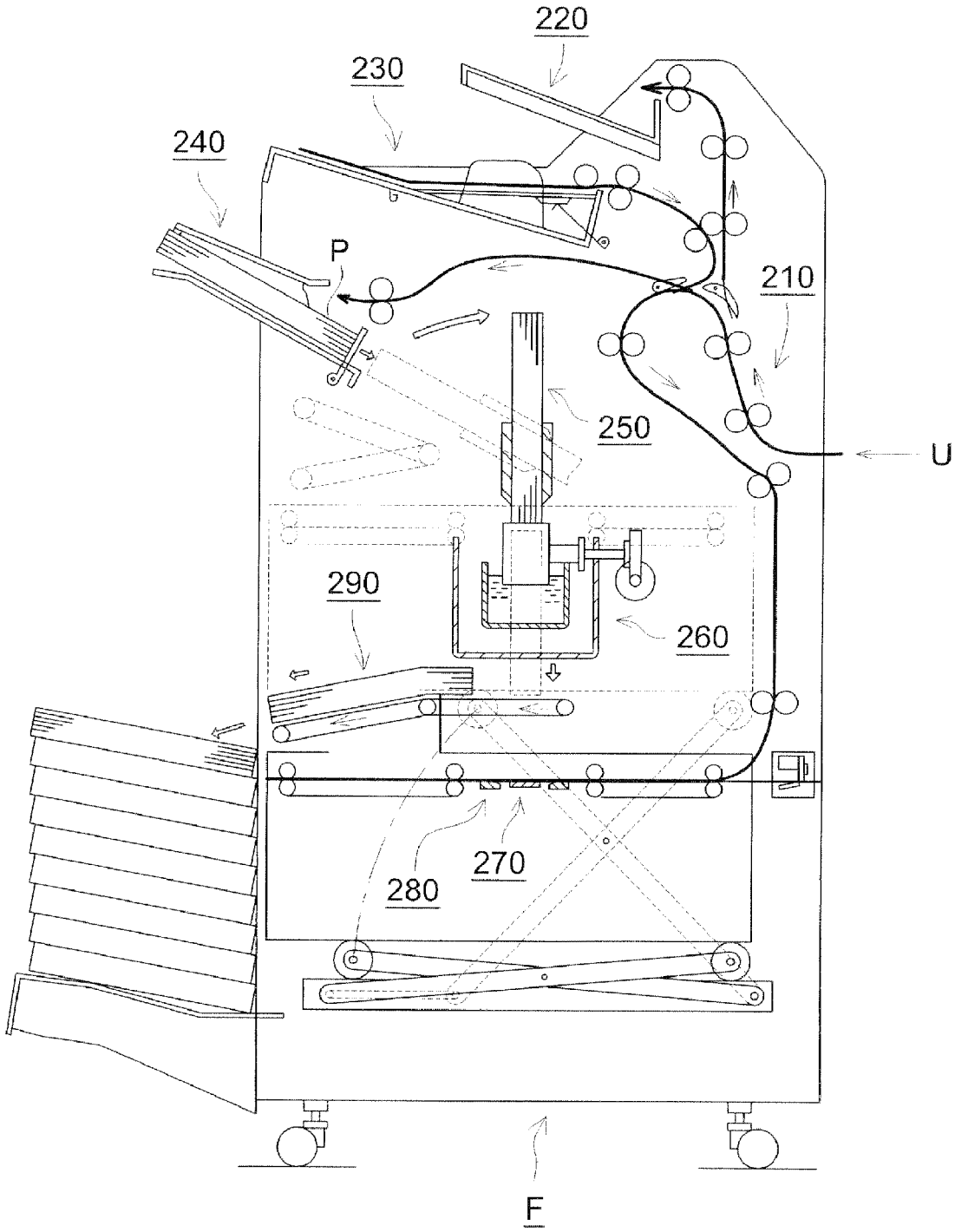
FIG. 3 is a schematic drawing of a post-finishing apparatus.

FIG. 3 is a schematic drawing of post-finishing apparatus F.

Post-finishing apparatus F is configured to stack the recording sheets, conveyed from sheet conveyance relay unit U, to form a bundle of recording sheets, and to adhere cover sheets onto said bundle of recording sheets.

Post-finishing apparatus F of the present embodiment is referred to as a book-binding apparatus, which includes sheet conveyance section 210, sheet ejection section 220, cover sheet supplying section 230, sheet-bundle accommodating section 240, sheet-bundle supporting section 250, adhesive applying section 260, cover sheet adhering section 270, cover sheet folding section 280, and finished booklet ejecting section 290.

As shown in FIG. 3, the above sections are vertically arranged in post-finishing apparatus F.

When a book binding job is conducted, the recording sheets are stacked sequentially on a predetermined position of sheet-bundle accommodating section 240, whereby a sheet-bundle, including a predetermined number of the recording sheets, is formed.

The sheet-bundle, formed on sheet-bundle accommodating section 240, is conveyed to sheet-bundle supporting section 250, whereby when said sheet-bundle supporting section 250 is rotated to be nearly vertical, the adhesive is applied onto the bottom of said sheet-bundle by adhesive applying section 260.

After a cover sheet is supplied from cover sheet adhering section 270 onto the bottom of the sheet-bundle, the cover sheet is folded by cover sheet folding section 280, whereby a booklet is finished.

Said finished booklet is then ejected from post-finishing apparatus F by finished booklet ejecting section 290.

Additionally, above post-finishing apparatus F is detailed in Unexamined Japanese Patent Application Publication No. 2004-209869.

Figure 4:
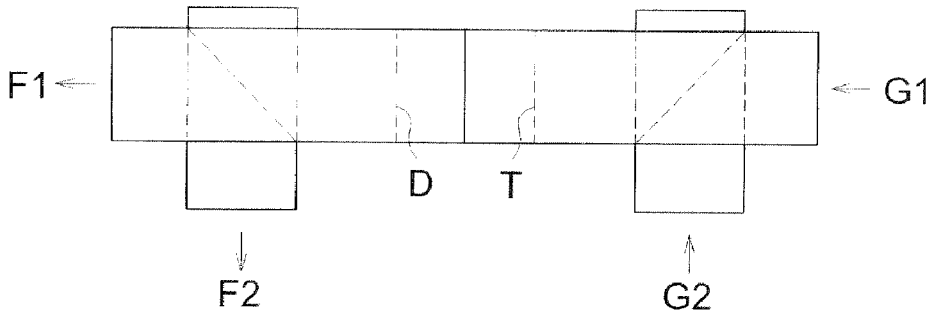
FIG. 4(*a*), FIG. 4(*b*), and FIG. 4(*c*) are schematic drawings of a sheet conveyance relay unit as an embodiment.
Figure 4:
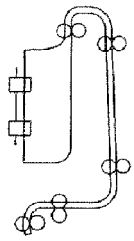
Figure 4:
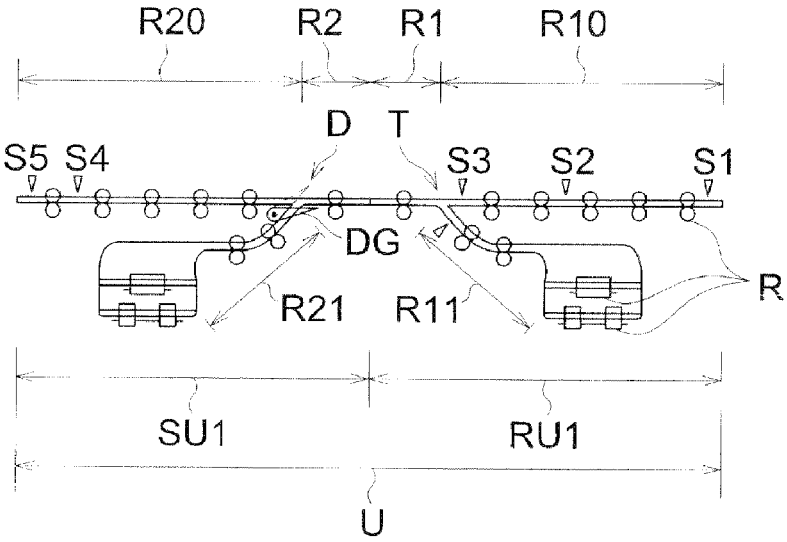

FIGS. 4(*a*), 4(*b*) and 4(*c*) are schematic drawings of sheet conveyance relay unit U, in which FIG. 4(*a*) is a top view, FIG. 4(*b*) is a front view, and FIG. 4(*c*) is a side view.

Sheet conveyance relay unit U is structured of a plurality of guide members (which are not illustrated) to control the conveyance direction of the sheet, divergence gate DC to change the conveyance direction of the sheet, conveyance roller group P including a plurality of paired rollers, roller driving member RD (which is not illustrated), and a plurality of sheet detecting sensors S to detect the recording sheet.

Figure 5:
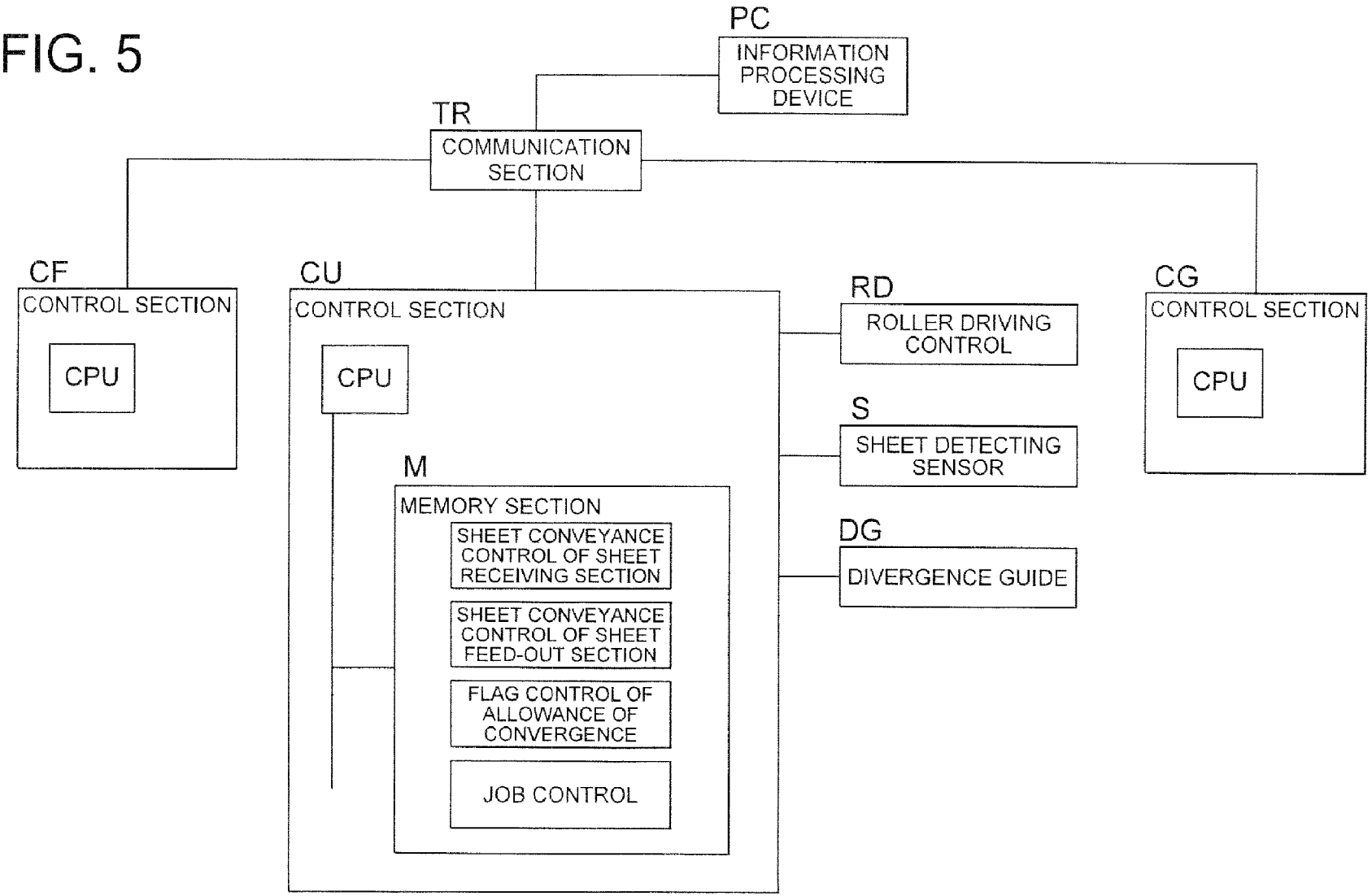
FIG. 5 is a block diagram of a control system of the sheet conveyance relay unit.

FIG. 5 is a block diagram of the control system of sheet conveyance relay unit U.

Control section CU is a computer system, including a CPU, memory section M, an input-output interface, a communication interface, and a plurality of driving circuits.

Control section CU conducts various control operations, by running predetermined programs which are stored in memory section M.

Control section CU, control section CG of image forming apparatus G, and control section CF of post-finishing apparatus F exchange information with each other through communication section TR.

In addition, any operational blocks, which have no relationship to the present invention, are not shown in FIG. 5.

Figure 6:
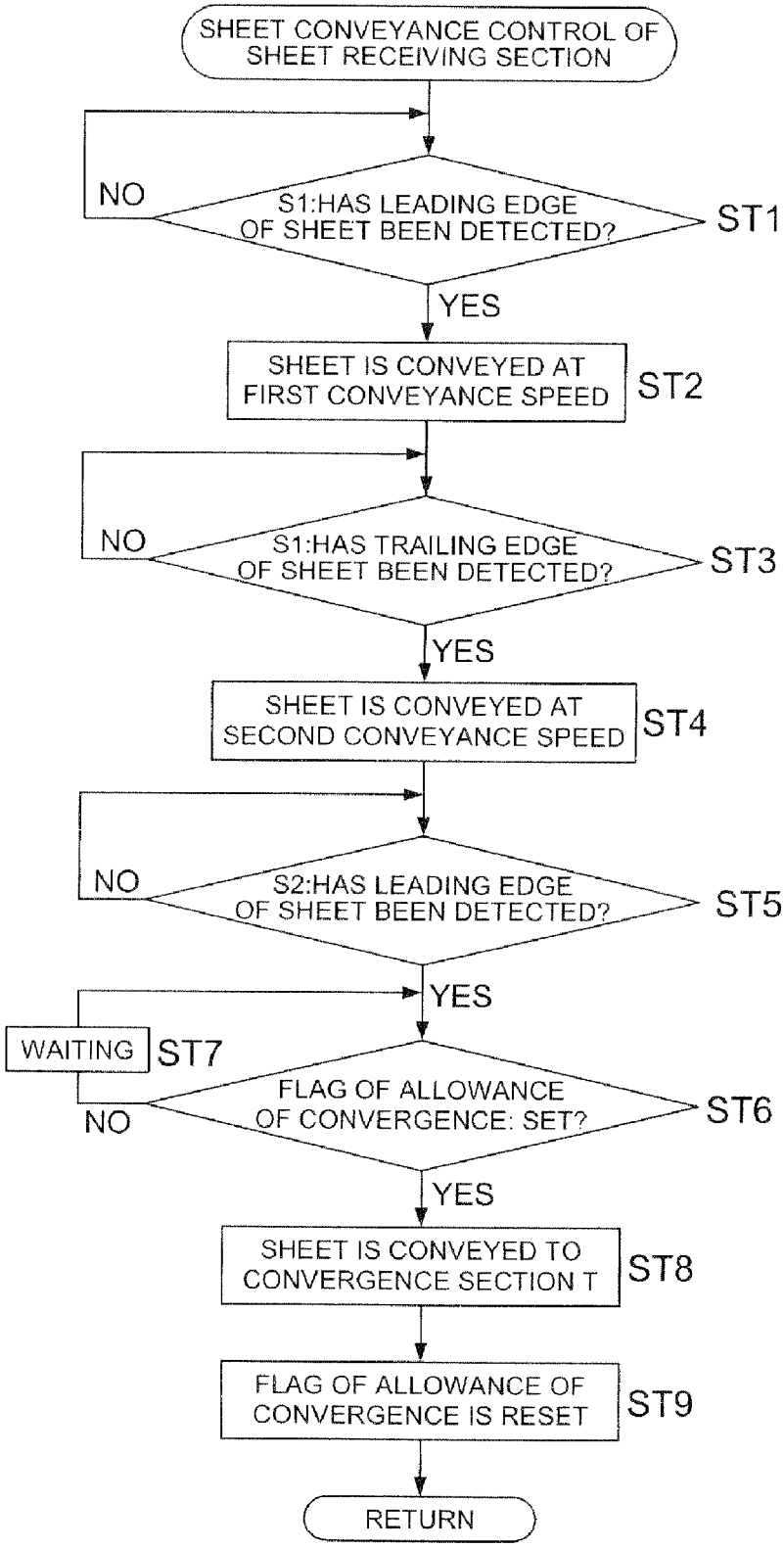
FIG. 6 shows a flow chart of a sheet conveyance control of a sheet receiving section.

FIG. 6 shows a flow chart of the recording sheet conveyance control of sheet receiving section R10 of sheet conveyance relay unit U.

In FIG. 1, the recording sheet, which was conveyed from image forming apparatus G1 to sheet conveyance relay unit U, is conveyed to post-finishing apparatus F1 or F2, based on a specification of a job, being job information, which has been set.

In sheet conveyance relay unit U, the recording sheet is conveyed by a plurality of rollers R driven by roller driving section RD. Said roller driving section RD is configured to rotate the plurality of conveyance rollers R, based on an instruction sent from control section CU.

When the leading edge of the recording sheet, sent from image forming apparatus G1, is detected by sheet detecting sensor S1 mounted on sheet receiving section 10 (Yes in step ST1), control section CU controls roller driving section AD to convey the recording sheet at a first conveyance speed, which is set to be equal to a sheet conveyance speed of image forming apparatus G1 (step ST2).

When the trailing edge of the recording sheet is detected by sheet detecting sensor S1 (Yes in step ST3), control section CU changes the sheet conveyance speed from the first conveyance speed to a second conveyance speed being greater than the first conveyance speed (step ST4).

When the leading edge of the recording sheet is detected by sheet detecting sensor S2 (Yes in step ST5), control section CU checks whether a flag to allow the sheet convergence has been set or not (step ST6), wherein said flag is set when no recording sheet exists in conveyance path r1 of first common sheet-conveyance section R1, or said flag is set when the distance between the recording sheet, having been conveyed from convergence section T, and another recording sheet, conveying through conveyance path r1, becomes greater than a predetermined distance.

If the flag to allow the sheet conveyance has not been set (No in step ST7), the sheet conveyance speed is reduced, and when the leading edge of the recording sheet reaches a predetermined position, the sheet conveyance is stopped, and the recording sheet is controlled to be a stand-by status (step ST7).

Additionally, in the present embodiment, an area of sheet receiving section R10, which is just before convergence section T to place the recording sheet into stand-by status, is referred to as a "buffer portion".

When the flag to allow the sheet convergence is set (Yes in step ST6), said recording sheet, remaining in the stand-by status, is conveyed toward convergence section T (step ST8).

When the leading edge of the recording sheet is detected by sheet detecting sensor S2 (Yes in step ST5), said flag to allow the sheet convergence has been set (Yes in step ST6), said recording sheet is conveyed toward convergence section T, without being placed into stand-by status (step ST8).

When the sheet conveyance is started toward convergence section T, the flag to allow the sheet convergence is reset, and the sheet conveyance, to convergence section T from other sheet receiving sections, is prohibited (step ST9), whereby the processing routine is completed.

Said recording sheet, having been conveyed from convergence section T to conveyance path r1 of first common sheet-conveyance section R1, is further conveyed through conveyance path r2 of second common sheet-conveyance section R2, and reaches divergence section D.

In divergence section D, conveyance path r2 of second common sheet-conveyance section R2 is divided into conveyance path x2 of sheet conveyance section R20, to convey the recording sheet to post finishing apparatus F1, and conveyance path y2 of sheet feed-out section R21, to convey the recording sheet to post finishing apparatus F2.

Divergence gate DG is mounted on said divergence section D, which changes the conveyance direction of the recording sheet, conveying through conveyance path r2 of second common sheet-conveyance section R2, into conveyance path x2 of said sheet feed-out section R20, or into conveyance path Y2 of sheet feed-out section R21, based on information instructed by control section CU.

Figure 7:
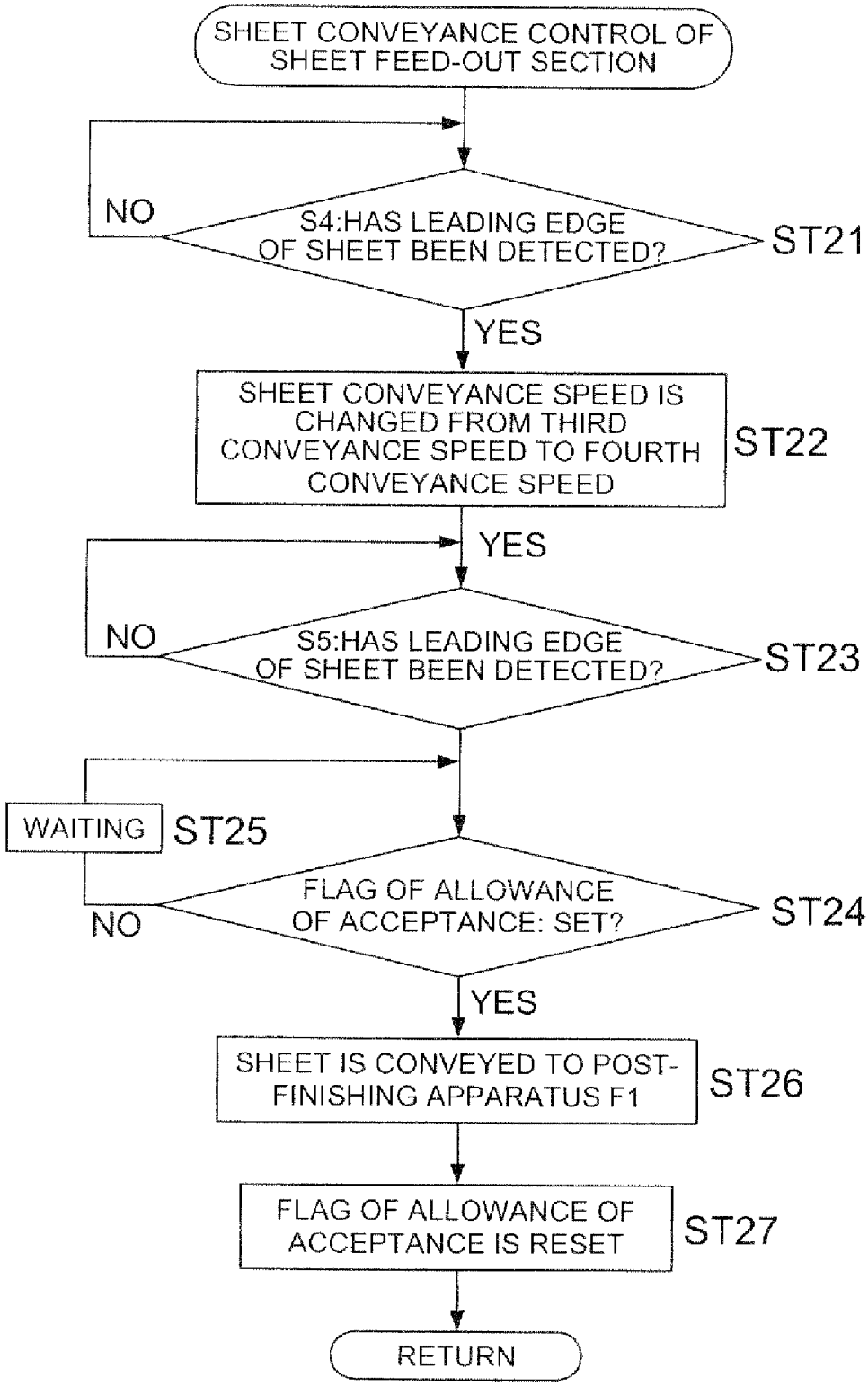
FIG. 7 shows a flow chart of a sheet conveyance control of a sheet feed-out section.

FIG. 7 shows a flow chart of the sheet conveyance on sheet feed-out section R10 of sheet conveyance relay unit U.

When the leading edge of the recording sheet, conveyed to sheet feed-out section R20, is detected by sheet detecting sensor S4 (Yes in step ST21), the conveyance speed of said recording sheet is reduced from a third conveyance speed, which is a conveyance speed of second common sheet-conveyance section R2, to a fourth conveyance speed at which the post finishing apparatus F1 receives the recording sheet (step ST22).

The recording sheet advances farther, and when the leading edge of said recording sheet is detected by sheet detecting sensor S5 (Yes in step ST23), a flag to allow the reception of the recording sheet into post finishing apparatus F1, being operational information, is checked whether said flag has been set or not (step ST24).

When the leading edge of the sheet is detected by sheet detecting sensor S5, if post-finishing apparatus F1 is in the sheet receivable condition (Yes in step ST24), said recording sheet is conveyed toward post finishing apparatus F1, without being stood by (step ST26).

When the leading edge of said sheet is detected by sheet detecting sensor S5, if post finishing apparatus F1 is in the sheet non-receivable condition (No in step ST24), said recording sheet is stopped at a predetermine position and placed into stand-by status (step ST25), which is used as positional information, and when post finishing apparatus F1 is changed to be in the sheet receivable condition (Yes in step ST24), said recording sheet is conveyed toward post finishing apparatus F1 (step ST26).

When said recording sheet is conveyed to post finishing apparatus F1, said sheet receivable flag is reset, whereby the processing routine is completed.

In addition, in the present embodiment, an area of sheet feed-out section R20, which is just before a sheet receiving portion of post finishing apparatus F1 to place the recording sheet into a stand-by status, is referred to as a "buffer portion".

Based on the flow charts of FIGS. 6 and 7, the operational flows have been detailed. That is, the recording sheet, conveyed from image forming apparatus G1, is conveyed by sheet receiving section R10, in which the recording sheet is conveyed horizontally and directly to convergence section T, and the recording sheet is also conveyed by sheet feed-out section R20, in which the recording sheet, received from divergence section D, is fed out horizontally and directly to post finishing apparatus F1.

The recording sheet, conveyed from image forming apparatus G2, is received by sheet receiving section R11, and said recording sheet is changed 90 degrees in its conveyance direction to be conveyed to divergence section T, in which the sheet conveyance and stoppage and the sheet conveyance speed, are controlled in the same way as the case of sheet receiving section R10, while controlled based on the detected signals coming from the plurality of sheet detecting sensors.

Further, sheet feed-out section R20, which conveys the recording sheet from convergence section D to post finishing apparatus F1 or F2, is controlled in the same way as the case of sheet feed-out section R21.

The difference between the sheet conveyance, conducted by sheet receiving sections R10 and R11, and the sheet conveyance, conducted by sheet feed-out sections R20 and R21, will be detailed below.

Figure 8:
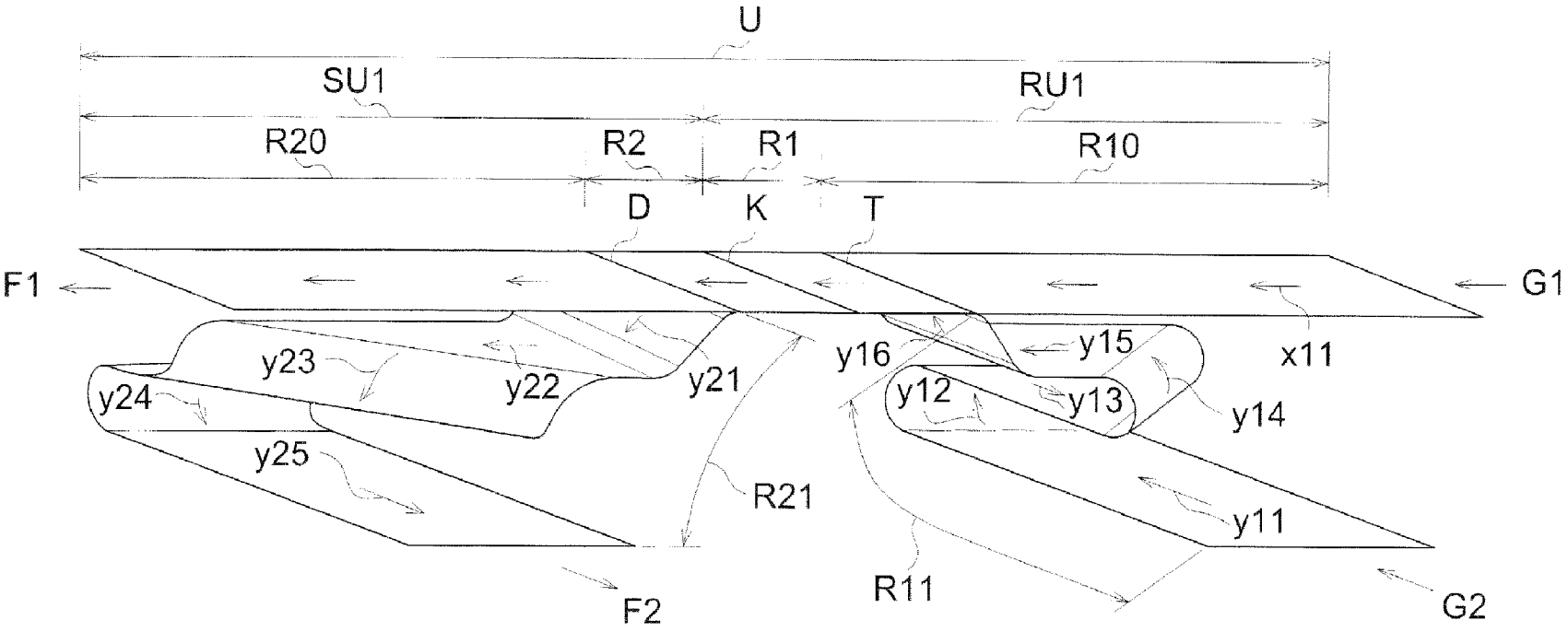
FIG. 8 shows conveyance directions of the recording sheet, and changing of the surfaces of the recording sheet to be conveyed.

FIG. 8 shows the conveyance direction of the recording sheet and the recording sheet to be reversed, in sheet conveyance relay unit U.

A plurality of arrows in FIG. 8 show the conveyance directions of the recording sheet within sheet conveyance relay unit U.

Sheet receiving section R11 conveys the recording sheet, conveyed from image forming apparatus G1, in direction y11. Said direction y11 makes a right angle with direction x11, wherein sheet receiving section R10 conveys the recording sheet, conveyed from image forming apparatus G2, in direction x11.

The sheet, being conveyed below sheet receiving section R10 in direction y11, is directed upward in direction y12, and then conveyed in direction y13. That is, the recording sheet is changed 180 degrees in its conveyance direction, and its surface is reversed.

After that, said recording sheet is changed 90 degrees in its conveyance direction below sheet receiving section R10 by a guide member (which is not illustrated), subsequently said recording sheet is conveyed upward in direction y14, and further conveyed in direction y15. That is, said recording sheet is changed 90 degrees in its conveyance direction, and said recording sheet is again reversed.

As described above, the recording sheet, conveyed from image forming apparatus G2, is then conveyed in direction y16, while its conveyance direction and its surface are the same as those of the recording sheet, conveyed from image forming apparatus G1, whereby the recording sheet, conveyed from image forming apparatus G2, reaches convergence section T.

Sheet feed-out section R21, which conveys the recording sheet, conveyed from divergence section D, to post-finishing apparatus F2, is structured nearly the same way as said sheet receiving section R10, whereby sheet feed-out section R21 conveys the recording sheet from divergence section D to post-finishing apparatus F2 in directions y21-y25.

As described above, in the sheet conveyance relay unit of the present invention, the recording sheet is always conveyed without changing the leading edge.

Due to this conveyance manner, the conveyance speed need not be reduced. Because, in conventional apparatuses, after the recording sheet is stopped, the edge of the recording sheet is turned 90 degrees to become the new leading edge for the subsequent conveyance, whereby the conveyance direction of said recording sheet is changed, which reduces the overall conveyance speed, and the processing capacity is increased in sheet conveyance relay unit U.

In sheet conveyance relay unit U of the present embodiment, all of the recording sheets to be conveyed pass through the common sheet-conveyance path, formed of conveyance path r1 of first common sheet-conveyance section R1, and conveyance path r2 of second common sheet-conveyance section R2.

Accordingly, the recording sheet, which is conveyed convergence section T through sheet receiving sections R10, should be controlled not to cause interference in conveyance timing with the recording sheet, which is conveyed to convergence section T through sheet receiving section R11. To overcome this problem, the flag to allow the sheet convergence is utilized, which was detailed based on FIG. 6.

Said flag to allow the sheet convergence is controlled by a program for controlling the flag to allow sheet convergence, whereby said flag is set or reset, based on the positions of the recording sheets, conveying through conveyance path r1 of first common sheet-conveyance section R1 and conveyance path r2 of second common sheet-conveyance section R2, as well as the positions of the recording sheets in sheet receiving sections R10 and R11.

However, the control of the flag by said program is not limited to the program which is conducted based on the positions of the recording sheets, conveying through conveyance path r1 of first common sheet-conveyance section R1 and conveyance path r2 of second common sheet-conveyance section R2, or based on the positions of the sheets in sheet receiving sections R10 and R11.

That is, the flag to allow the sheet convergence is controlled, based on the processing capacity of each image forming apparatus, and selected specifications of jobs to be conducted, such as priority of the operation, recording sheet sizes, type of the post finishing operation, and working condition of the post finishing apparatus, being job information.

In order to conduct the above control, information concerning the specification and the working conditions of image forming apparatuses G1 and G2, and those of post finishing apparatuses F1 and F2, and information concerning the specifications of the selected jobs, are sent to control section CU, through communication section TR.

Control section CU executes the job control program stored in a memory section, whereby control section CU determines an executing order and executing method of determined jobs, based on the job information, and after control section CU selects image forming apparatuses and post finishing apparatuses to be operated, control section CU sends information to allow starting the jobs to the selected image forming apparatuses and post finishing apparatuses.

After receiving said information, image forming apparatuses G1 and G2, and post finishing apparatuses F1 and F2 start to conduct the predetermined operations.

As detailed above, control section CU of sheet conveyance relay unit U of the present invention conducts the job control of the image forming system, structured of image forming apparatuses G1 and G2, post finishing apparatuses F1 and F2, and sheet conveyance relay unit U.

In addition, the job is determined via the operation section of sheet conveyance relay unit U, or the job is determined via the operation sections of image forming apparatuses G1 and G2, connected to sheet conveyance relay unit U, or those of post finishing apparatuses F1 and F2, so that information of the determined jobs are sent to control section CU.

In the above descriptions, the image forming system is detailed as the embodiment of the present invention, in which two image forming apparatuses are combined with two post-finishing apparatuses by the sheet conveyance relay unit. However, since the sheet conveyance relay unit of the present invention can combine convergence units with each other, or can combine divergence units with each other, the number of the image forming apparatuses and the number of the post-finishing apparatuses to be combined are not specifically limited.

Figure 9:
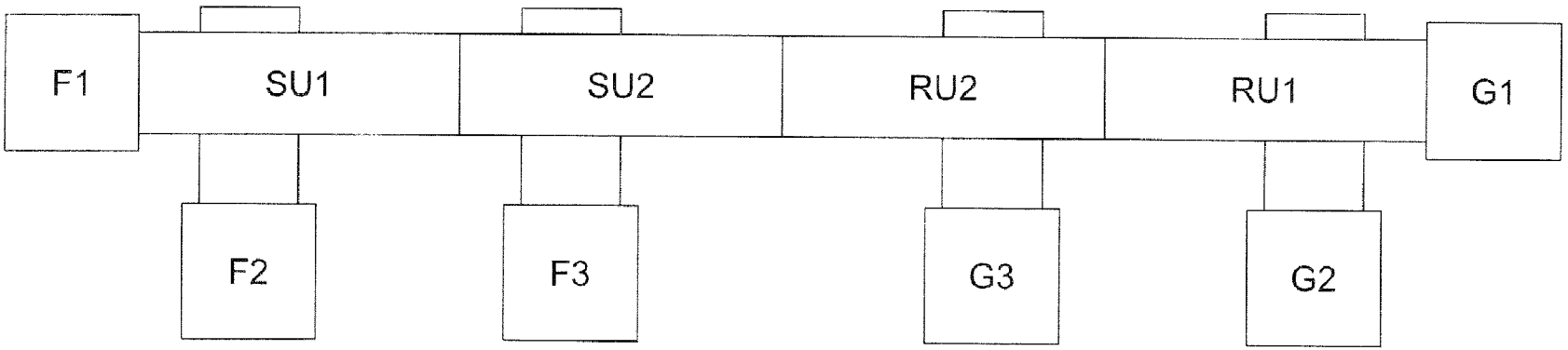
FIG. 9 shows an image forming system of another embodiment, in which three image forming apparatuses and three post-finishing apparatuses are combined by a sheet conveyance relay unit, as another embodiment.

FIG. 9 shows an image forming system of another embodiment, including three image forming apparatuses, and three post finishing apparatuses, connected to a sheet conveyance relay unit.

Accordingly, the sheet conveyance relay unit of the present invention can realize an image forming system exhibiting expanded capability.

Based on the sheet conveyance relay unit of the present invention, the number of combinations, which are with respect to the plurality of the image forming apparatuses and the plurality of the post-finishing apparatuses, can be increased. Further, in order to meet the jobs, the apparatuses are selected, so that the combinations can be easily changed.

Further, based on the sheet conveyance relay unit of the present invention, the image forming system, which can work for the diversifying jobs, can be realized.

Still further, since the plurality of jobs can be processed in parallel by the sheet conveyance relay unit, productivity of the image forming system can be improved.

What is claimed is:

1. A sheet conveyance relay unit, comprising:

a convergence unit, including:

a convergence section having a plurality of sheet receiving sections respectively connected to a plurality of image forming apparatuses to receive recording sheets, wherein sheet conveyance paths of the plurality of the sheet receiving sections are converged; and a first common sheet-conveyance section, which is configured to convey the recording sheets from the convergence section to a sheet feeding outlet;

a divergence unit, including:

a second common sheet-conveyance section, which is configured to convey the recording sheets conveyed from the convergence unit;

a plurality of sheet feed-out sections, which are connected to a plurality of post-finishing apparatuses; and a divergence section, which sorts the recording sheets conveyed by the second common sheet-conveyance section, onto the plurality of the sheet feed-out sections; and a control section which is configured to receive (i) job information having been set, and (ii) specifications and working conditions information relating to the plurality of the image forming apparatuses connected to the convergence unit and the plurality of the post-finishing apparatuses connected to the divergence unit;

wherein the control section selects an image forming apparatus to be used for a job among the plurality of the image forming apparatuses and selects a post-finishing apparatus to be used for a job among the plurality of the post-finishing apparatuses, based on the specifications and working conditions information, so that the control section conducts the job having been set.

2. The sheet conveyance relay unit of claim 1, wherein each of the plurality of the sheet receiving sections includes a buffer portion in which the recording sheet to be sent to the convergence section is temporarily placed into a stand-by status.

3. The sheet conveyance relay unit of claim 1, wherein each of the plurality of the sheet feed-out sections includes a buffer portion in which the recording sheet to be sent to the plurality of the post-finishing apparatuses is temporarily placed into a stand-by status.

4. The sheet conveyance relay unit of claim 1, wherein the divergence unit includes a divergence gate to sort the recording sheets conveyed from the second common sheet-conveyance section into the plurality of the sheet feed-out sections.

5. The sheet conveyance relay unit of claim 1, wherein the control section is configured to change a sheet conveyance speed from a first conveyance speed to a second conveyance speed, based on positional information of the sheet being conveyed by the sheet receiving section, and wherein the first conveyance speed represents a speed at which an image forming apparatus among the plurality of the image forming apparatuses feeds out the sheet, and the second conveyance speed represents a speed greater than the first conveyance speed.

6. The sheet conveyance relay unit of claim 1, wherein the control section is configured to change the sheet conveyance speed from a third conveyance speed to a fourth conveyance speed, based on positional information of the sheet being conveyed by the sheet feedout section, and wherein the third conveyance speed represents a speed at which the second common sheet-conveyance section conveys the sheet, and the fourth conveyance speed represents a speed equal to a sheet conveyance speed at which a post-finishing apparatus among the plurality of the post finishing apparatuses receives the sheet.

7. The sheet conveyance relay unit of claim 1, wherein the control section is configured to receive the job information and the specifications and working conditions information through a communication section.

8. The sheet conveyance relay unit of claim 1, wherein the control section is configured to select an image forming apparatus to receive the recording sheet, and a post-finishing apparatus to feed out the recording sheet, based on the job information, and wherein the control section is configured to control a timing to feed out the sheet from the sheet receiving section to the convergence section, based on positional information of the sheet which is being conveyed by the sheet receiving section and the first common sheet-conveyance section.

9. The sheet conveyance relay unit of claim 1, wherein the control section is configured to control the sheet conveyance speed and a timing to feed out the sheet from the sheet feed-out section to the post-finishing apparatus based on (i) operation information showing an operational status of the post-finishing apparatus, and (ii) positional information showing a position of the sheet being conveyed by the sheet feed-out section.

10. An image forming system, including:

a plurality of image forming apparatuses, each forming an image on a sheet;

a plurality of post-finishing apparatuses, each conducting a post-finishing process on the sheet; and the sheet conveyance relay unit of claim 1, which receives the sheets having been sent from the plurality of the image forming apparatuses, and which sequentially conveys the sheets to the plurality of the post-finishing apparatuses, wherein the plurality of the image forming apparatuses and the plurality of the post-finishing apparatuses are connected to the sheet conveyance relay unit.

* * * * *